US008365430B2

(12) United States Patent
Veltel et al.

(10) Patent No.: US 8,365,430 B2
(45) Date of Patent: Feb. 5, 2013

(54) CENTRIFUGAL DRYER

(75) Inventors: Juergen Veltel, Kavelaer (DE); Thomas Baaske, Geldern-Pont (DE); Markus Peters, Xanten (DE); Christoph Maesmanns, Kerken (DE)

(73) Assignee: Gala Industries, Inc., Eagle Rock, VA (US)

( * ) Notice: Subject to any disclaimer, the term of this patent is extended or adjusted under 35 U.S.C. 154(b) by 557 days.

(21) Appl. No.: 12/450,306

(22) PCT Filed: Mar. 18, 2008

(86) PCT No.: PCT/EP2008/002168

§ 371 (c)(1),
(2), (4) Date: Sep. 21, 2009

(87) PCT Pub. No.: WO2008/113560

PCT Pub. Date: Sep. 25, 2008

(65) Prior Publication Data

US 2010/0037477 A1 Feb. 18, 2010

(30) Foreign Application Priority Data

Mar. 19, 2007 (DE) ..... 20 2007 003 978 U
Mar. 27, 2007 (DE) ..... 20 2007 004 462 U

(51) Int. Cl.
*F26B 17/24* (2006.01)
*F26B 11/12* (2006.01)
*B01D 35/00* (2006.01)

(52) U.S. Cl. ..... 34/58; 34/59; 34/182; 34/183; 210/374

(58) Field of Classification Search ..... 34/58, 59, 34/172, 182, 183; 210/374, 377
See application file for complete search history.

(56) References Cited

U.S. PATENT DOCUMENTS

| | | | | |
|---|---|---|---|---|
| 301,803 | A | 7/1884 | Cavanaugh | |
| 1,428,010 | A | 9/1922 | Daniels | |
| 3,241,675 | A * | 3/1966 | Pashaian et al. | 210/360.2 |
| 3,458,045 | A | 7/1969 | Dudley | |
| 4,190,678 | A * | 2/1980 | Pleus | 426/478 |
| 5,265,347 | A | 11/1993 | Woodson et al. | |
| 6,138,375 | A * | 10/2000 | Humphries et al. | 34/59 |
| 6,438,866 | B1 | 8/2002 | Meydell et al. | |
| 6,467,188 | B1 | 10/2002 | Sandford | |
| 6,505,416 | B2 | 1/2003 | Sandford | |
| 7,024,794 | B1 * | 4/2006 | Mynes | 34/59 |
| 2003/0033725 | A1 | 2/2003 | Humphries, II et al. | |

FOREIGN PATENT DOCUMENTS

| | | |
|---|---|---|
| DE | 43 30 078 A1 | 3/1994 |
| DE | 600 10 162 T2 | 8/2004 |
| EP | 0 325 253 A2 | 7/1989 |
| EP | 1 033 545 A1 | 9/2000 |
| WO | WO 01/59379 A1 | 8/2001 |

* cited by examiner

*Primary Examiner* — Kenneth Rinehart
*Assistant Examiner* — John McCormack
(74) *Attorney, Agent, or Firm* — Jacobson Holman PLLC

(57) ABSTRACT

A centrifugal dryer for the separation of pellet-like substances from process water including a housing, a rotor arranged in the housing and a screen surrounding the rotor at the peripheral side. The screen has at least one porous screen member which is placed in an arcuate manner around at least one screen carrier hoop and is releasably fastened thereto. The screen is composed of a plurality of screen members which mutually overlap in the peripheral direction and are clamped tight to the screen carrier hoop by one or more tension belts which wrap around the mutually overlapping screen members at the peripheral side.

53 Claims, 5 Drawing Sheets

CENTRIFUGAL DRYER

This is a national stage of PCT/EP08/002168 filed Mar. 18, 2008 and published in German, which has a priority of German no. 20 2007 003 978.6 filed Mar. 19, 2007 and German no. 20 2007 004 462.3 filed Mar. 27, 2007, hereby incorporated by reference.

BACKGROUND OF THE INVENTION

1. Field of the Invention

The present invention relates to a centrifugal dryer for the separation of pellet-like substances from process water, comprising a housing, a rotor arranged in the housing and a screen surrounding the rotor at the peripheral side, with the screen having at least one porous screen member which is placed in an arcuate manner around at least one screen carrier hoop and is releasably fastened thereto.

2. Description of the Related Art

Plastic pellets which are manufactured by underwater pelletizing are continuously separated from the process water of the pelletizer system by centrifugal dryers connected downstream of the underwater pelletizers. Such centrifugal dryers, which can optionally also be used for the separation of other pellet-like substances from a corresponding fluid, usually have a rotor which stands upright, which is rotationally driven about an upright rotor axis and conveys the pellets or the pellet-water mixture from the bottom to the top by means of usually bucket-like conveying members, with the mixture being thrown radially outwardly. In this process, the pellets are retained in the screen surrounding the rotor, while the water or the corresponding fluid can pass through the porous screen members and can run off outside the screen.

Depending on the pellet size, sealing problems occur at the screens in this process. In this respect, seam points between individual screen members of which the screen is made up are in particular critical, as well as connection points between the screen members and connection bodies such as inlet stubs, outlet stubs and the like. There is also the fact in this respect that the screens must be cleaned and/or replaced regularly so that it is necessary to fasten the individual screen members releasably to the screen carrier, which is normally made up of a plurality of screen carrier hoops, so that the screen members can be removed, cleaned and replaced as necessary. The corresponding seam and connection points are in this respect particularly prone to sealing problems.

Usually, in this respect, flexible, bendable, board-like or plate-like screen members are used which can be placed around the screen carrier hoops in an arcuate or drum-jacket-like manner. The screen members have at their axially extending ends, which are adjacent in the position placed around the screen carrier hoops in the manner of a hoop, corresponding holding pieces, for example in the form of angle pieces or holding flanges, which are usually welded firmly to the usually metallic screen members or are optionally also clamped tight and then fixed for the purpose of the fastening of the screen members to one another. For example, U.S. Pat. No. 6,467,188, U.S. Pat. No. 6,505,416 or U.S. Pat. No. 6,438,866 show such cylindrical screens of centrifugal dryers in which screen members which are planar per se are first rolled up cylindrically and holding pieces are welded tight to the rims of the screen members which are then drawn together by screw-like clamping members. A centrifugal dryer for pellets is furthermore known from DE 43 30 078 A1 in which the screen is made up of two half-cylindrical shells. Each of the shell-like screen members is in this connection enclosed at its rims by a hoop-iron-like, belt-like frame section to which the actual screen member is welded tight. Two oppositely disposed frame section limbs are in this respect arched in the shape of a semi-circular arc so that the screen member is given a semi-cylindrical shell shape overall. The two half-screen shells are in this respect pivotally connected to one another in the manner of a hinge at two longitudinal-side frame sections so that the screen can be folded open.

Such screen constructions are capable of improvement in a variety of respects. On the one hand, they are relatively complex and/or expensive to manufacture since care must be taken that the screen members themselves are not deformed on the welding tight of the holding members at the screen member rims. If nevertheless welding deformation occurs, sealing problems arise. On the other hand, the screen members can only be rolled forward with difficulty, in particular when very stiff screen members have to be used for corresponding applications. The assembly and disassembly of the screen members is hereby made correspondingly more difficult.

Furthermore, screens made in this manner have little variability. If, for example, connection parts such as supply shafts or lead-off shafts should be connected to the screen at the periphery which communicate through the screen with the screen interior, the holding members or frame sections welded tight to the screen members are occasionally in the way. In addition, ultimately only one hole can be cut exactly to size in the screen to connect a supply shaft, for example.

SUMMARY OF THE INVENTION

Starting from this, it is the underlying object of the invention to provide an improved centrifugal dryer of the initially named kind which avoids disadvantages of the prior art and further develops the latter in an advantageous manner. In particular a screen for such a centrifugal dryer should be provided which is cost-effective in manufacture and which is simple to assemble and disassemble without sealing problems and pellet leakage and which can be variably adapted to different connection configurations.

This object is solved in accordance with the invention by a centrifugal dryer for pellet-like substances from a fluid, having a housing, a rotor arranged in the housing as well as a screen surrounding the rotor at a peripheral side thereof. The screen has at least one porous screen member which forms at least one sector of a peripheral surface of the screen and is placed in arcuate form around at least one screen carrier hoop and is releasably fastened thereto. The screen, which is connectable to a connection body arranged at the peripheral side, has mutually overlapping screen member ends, viewed in a peripheral direction, which are each clamped tight on the screen carrier hoop by at least one tension belt which wraps around the mutually overlapping screen members at the peripheral side. The connection body has a clamping device adjacent to the screen, with a respective screen member adjacent to the connection body being clampable by the clamping device to a screen member end overlapping the connection body in the peripheral direction.

In contrast to the prior art, the previously taken path is left of fastening separate fastening or holding members to the screen member edges which are adjacent to one another in the rolled up state and which introduce the tension into the screen members on being clamped together. In accordance with the invention, the screen is composed of a plurality of screen members which overlap one another in the peripheral direction or of a screen member having mutually overlapping screen member ends in the peripheral direction and are clamped tight on the screen carrier hoop by one or more tension belts which wrap around the mutually overlapping screen members at the peripheral side. Generally differently formed, pliable, flexible and/or resiliently flexible tension members can be wound around screen members as a tension belt and are tensioned and hereby hold the screen members together and in particular pull them toward screen carrier hoops arranged on the inner side. The screen member fastening by such tension belts is characterized by a simple manufacturing capability and a tight seal and freedom from leaks. In particular, no heat deformations of the screen members occur, which arise, for example, on the welding on of holding pieces so that a large freedom from leaks can be achieved in a simple manner.

In this respect, the design of the screen from a plurality of screen members which are simply placed over one another with an offset to one another so that they overlap one another when viewed in the peripheral direction is of particular advantage. Different screens of different diameter or with different connection options can hereby be configured by screen members configured in a standard manner since, for example, an additional screen member is simply placed onto the screen hoop or the overlap offset is set smaller for the generation of a larger screen diameter. The mutually overlapping screen members can be displaced with respect to one another in the peripheral direction so that a connection gap arises for the introduction of connection pieces at the peripheral side. This can all also be subsequently changed since the screen members are not fixedly connected to holding members or are not welded onto frame sections, but are only clamped onto the screen hoops by the tension belts in a friction locking manner.

In addition, the radial forces acting on the screen are taken up by the tension belts wrapped around the screen members as a consequence of the outwardly thrown pellet/process water mixture so that no pulling apart of the screen members at the seam points occurs.

The screen members can in particular themselves be free of fastening and holding members. Advantageously, specifically the holding pieces otherwise usually welded to the screen member rims no longer have to be provided. The screen members are only held together by the tension belts. Nothing has to be welded tight or otherwise fastened to the axial longitudinal edges of the screen members. The screen member edges prone to sealing problems are placed individually on one another in a mutually overlapping manner and are held on one another by the tension belts, with the screen member edges disposed over one another being able to maintain their elasticity due to the lack of welded holding pieces and can be fully disposed on one another without gaps or slits.

Due to the formation of the screen members free of weld points or weld seams, said screen members remain free of heat deformation so that there are in particular no sealing problems at the screen member edges or rims.

The screen members do not have to be completely free of weld seams. To avoid the aforesaid sealing problems as a consequence of heat deformation, it can be sufficient to make the screen member edges of rims free of weld seams. In particular the tension belts can namely be attached to the screen members by weld spots with a suitable, in particular metallic, design in order to allow an easier handling and to avoid slipping so that an exactly fitting, correct installation without slipping of the belts can be brought about more easily. Advantageously, in this respect, screen members, for instance, can, for example, be attached centrally to the respective tension belts by one or more weld spots. Alternatively or additionally, the tension belts can also be attached to the screen members or be connected thereto in a different manner, for example by adhesive bonding.

Advantageously, the production of the screen members themselves is simplified by the fastening of the screen members by the tension belts wrapped around them since no particular accuracy to size has to be observed on the cutting to size of said screen members. It only has to be ensured that a sufficient overlap occurs on the rolling of the screen members onto the screen carrier hoops.

Furthermore, a substantially larger design freedom can be achieved in the screen member arrangement and in the composition of a screen from a plurality of screen members. Although the screen is composed of a plurality of mutually overlapping screen members, when viewed in the peripheral direction, which each form a jacket surface sector and only form the totally cylindrical screen jacket together, the plurality of screen members viewed in the peripheral direction are advantageously connected to one another and held together solely by tension belts. In a further development of the invention, in this process, at least two screen carrier hoops can be used onto which the plurality of screen members are clamped by the tension belts. The screen members mutually complementing one another in the peripheral direction can in this respect be of different size and/or have different thicknesses; for example, a first screen member piece can cover a sector of $\frac{3}{2}\pi$ and a second screen member can cover the remaining sector of $\frac{1}{2}\pi$, with the corresponding overlap naturally having to be added. In a further development of the invention, the screen members can be displaced toward one another in the peripheral direction, whereby the width of the overlap can be changed and the screen diameter can be changed as required by inserting another screen hoop.

In a further development of the invention, the screen can also be composed of a plurality of screen members when viewed in the axial direction, with the plurality of screen members also advantageously being connected to one another held together solely by tension belts in this case. In this respect, a plurality of screen carrier hoops are preferably provided onto which the screen members are clamped by means of the tension belts, with such a screen carrier hoop in particular being provided in the region of the axial seam point between two screen sections.

In a further development of the invention, each axial screen section advantageously has at least two screen carrier hoops in this respect which are preferably arranged on the end-face end sections of the respective screen section, with a common screen carrier hoop for both screen sections preferably being able to be provided at an axial interface between two screen sections.

The axially mutually adjacent screen members can in this respect be fastened to said common screen carrier hoop in generally different manners. In accordance with a further development of the invention, the screen members can mutually overlap axially on the screen carrier hoop and can be clamped tight by a common tension belt arranged in the axial overlap region. In an alternative, advantageous embodiment of the invention, the common screen carrier hoop can, however, also have a radial separation web which divides the common screen carrier hoop into two clamping sections at the peripheral side. The screen members can be aligned axially toward the said separation web in the manner of an abutment and can then be clamped tight on the common screen carrier hoop by a respective separate tension belt.

In accordance with a further aspect of the present invention, at least one connection body, for example in the form of an inlet shaft, of an outlet shaft or of any other connection stub, can be connected to the screen at the peripheral side by means of a releasable connection apparatus, with the screen or the porous screen member having a cut-out at the peripheral side in the region of this connection body. Such connection bodies are frequently provided in the region of a lower or upper end region of the screen, for example to guide the pellet/fluid mixture into the rotor section. In the region of the seam points of the screen or of the screen members to this connection body, the initially described leak problems are likely to occur. On the other hand, the screen assembly or disassembly is frequently costly and complicated just in these regions. Provision is made in this respect in a further development of the invention that the corresponding screen member is also fastened by at least one tension belt in the region of such a connection body at the peripheral side, with the tension belt advantageously simultaneously holding the connection body at the screen. The tension belts in the region of such a connection body in this respect therefore advantageously satisfy a dual function in that they, on the one hand, connect the screen body and the connection body to one another and, on the other hand, fix the screen member or screen members and hold them sealingly together in this section of the screen in the aforesaid manner by wrapping around them.

In this respect, pivotal connection points for at least one tension belt are provided in a particularly advantageous manner at the connection body so that the respective tension belt can be hinged at the two sides of the connection body at the peripheral side. In a particularly advantageous further development of the invention, a clamping rail is provided which can be releasably and pivotally fastened to the connection body and which, on the other hand, has pivotal connection points for the at least one tension belt so that the tension belt can be hinged at the clamping rail.

In accordance with a preferred embodiment of the invention, the clamping rail can in this respect be releasably hung at the connection body by means of hinge joint bolts so that the clamping rail is, on the one hand, easily releasably from the connection body by axially pulling the hinge joint bolt and/or pulling off the clamping rail itself and, on the other hand, can hinge about a hinge joint axis parallel to the longitudinal axis of the screen with respect to the connection body, whereby the screen member pushed under or over the clamping rail can be clamped by clamping the tension belts hinged thereto. In a further development of the invention, said clamping rail can form together with a marginal web of the connection piece a slit-shaped reception part into which the screen member can be inserted at the rim side. If the tension belts hinged at the clamping rail are tightened, the mouth closes, so-to-say, and the clamping rail is pulled onto the marginal web of the connection piece, whereby the screen member is securely fixed.

To achieve a simple and fast assembly and disassembly of the screen members, a respective clamping means which can be actuated without a tool and which allows the tension belts to be relaxed by hand is advantageously associated with the tension belts. A fast-clamping lever in the manner of a ski-boot buckle can in this respect be provided for each tension belt and is fastenable to an end of the respective tension belt and is able to be pivoted at the oppositely disposed end of the tension belt, in particular is able to be hung in by means of a hanger. Instead of such a shape-matched hanger, optionally, in particular with pliable tension belts, provision can be made that the oppositely disposed end of the tension belt is looped through a fixing member attached to the clamping lever or is wrapped around it so that the tension belt is held by clamping and is clamped by switching the clamping lever.

The screen design can particularly advantageously consist of screen members mutually overlapping in the peripheral direction for rotationally standing screens in which the initially named rotor is rotationally received. Whereas with rotary screens which rotate themselves and optionally rotate at high speeds in a liquid bath, as is shown in DE 14 32 766, and the screen, considered in the peripheral direction, was made up of only a single screen member and screen overlap regions by flush joining together as butt joints by means of suitable frame sections were preferred to avoid turbulences induced by the overlap regions, in contrast to this such overlap edges do not play any role with standing screens. It is rather the case that particularly with standing screens the variable connection possibilities for connection shafts and the like on the peripheral side are of advantage since particularly standing screens have such connection parts at the peripheral side.

BRIEF DESCRIPTION OF THE DRAWINGS

The invention will be explained in more detail in the following with respect to a preferred embodiment and to associated drawings. There are shown in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
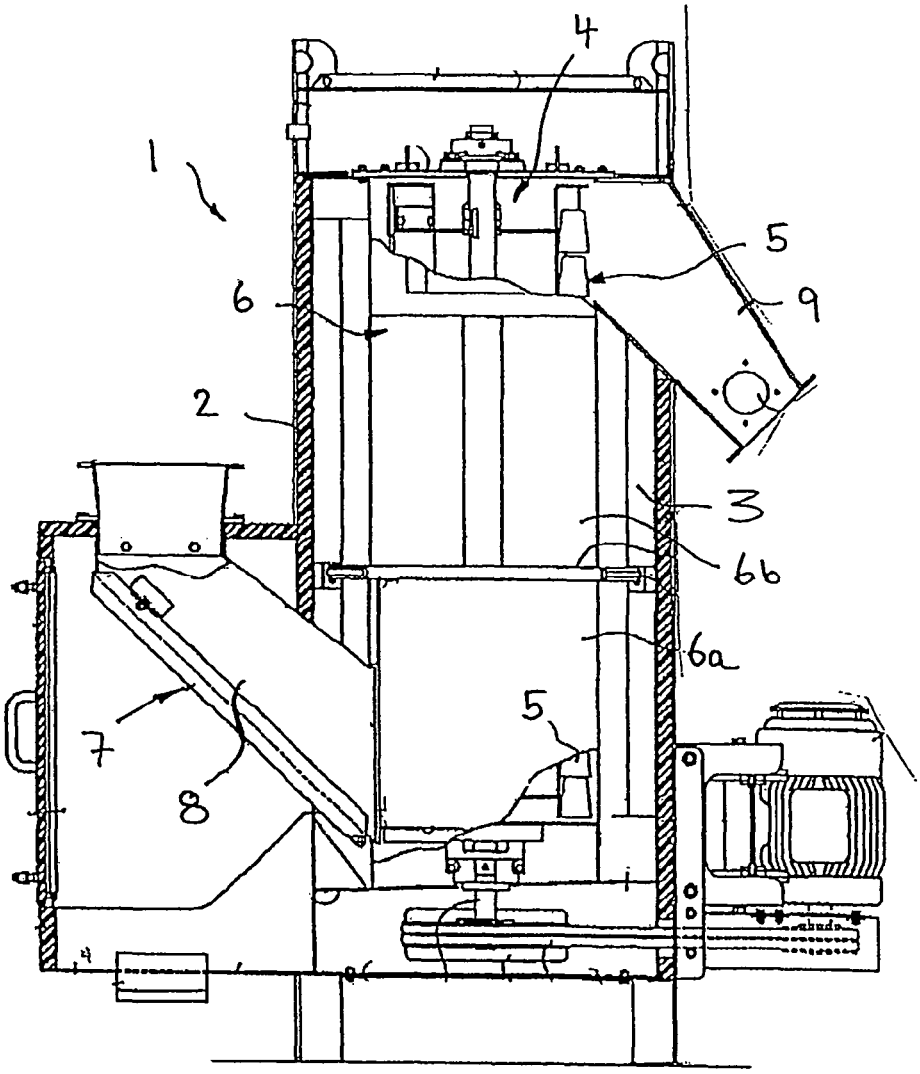
FIG. 1: a schematic longitudinal section through a centrifugal dryer in accordance with a preferred embodiment of the present invention.

The centrifugal dryer 1 drawn in FIG. 1 includes a housing 2 which is—roughly speaking—cylindrical overall and which is closed by a door which is provided at the jacket-surface side and through which the inner space 3 of the housing 2 is accessible. A rotor 4 is arranged in the inner space 3 of the housing 2 and can be driven by an upright rotary axle by means of a drive motor not shown in detail. As FIG. 1 indicates, the rotor 4 includes a plurality of bucket-like conveying members 5 which are arranged projecting from the central rotor axle and convey pellet/process water mixture introduced into the centrifugal dryer 1 from bottom to top in the inner space 3 of the housing 2. The conveying members 5 projecting from the rotor axle can in this respect generally have different designs, for example in the form of planar, arched or curved plates or in the form of spiral, curved members or of conveying members shaped in a different manner.

The rotor 4 is in this respect surrounded in the inner space 3 by a screen 6 which is cylindrical overall and which surrounds the rotor 4 such that pellets thrown outwardly by the rotor 4 on the conveying are retained in the inner space surrounded by the screen 6, whereas process water can pass through the screen 6 and can run downwardly in the gap between the screen 6 and the housing 2.

Figure 2:
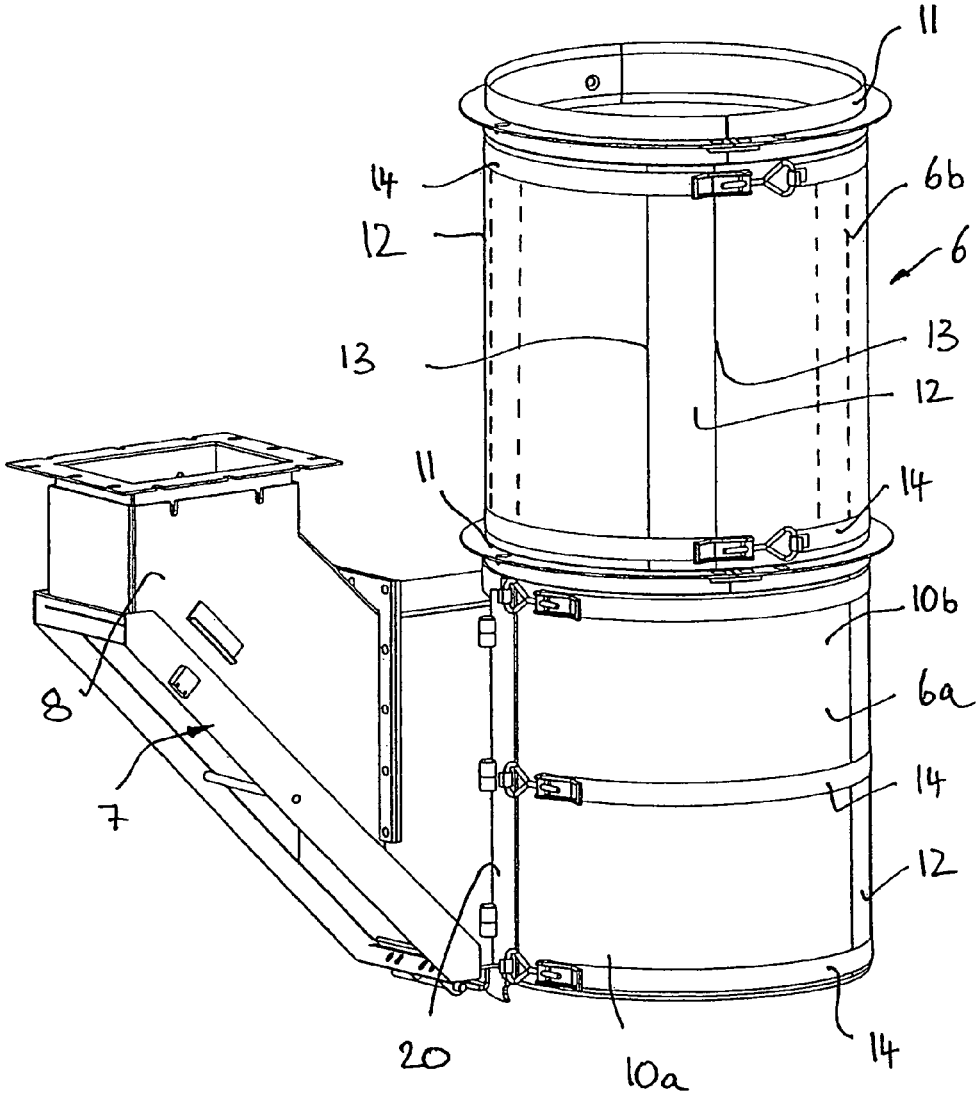
FIG. 2: a section-wise, perspective view of the screen of the centrifugal dryer of FIG. 1 surrounding the rotor with the inlet shaft connected to the lower screen section.

As FIGS. 1 and 2 show, a connection body 7 in the form of an inlet shaft 8 through which the pellet/fluid mixture can be moved through the screen 6 onto the rotor 4 is connected to the screen 6 at a lower screen section 6*a* at the jacket surface side. The inlet shaft 8 can, for example, be connected in a manner known per se to an underwater pelletizing system which generates the plastic pellets and introduces the pellet/fluid mixture arising in this respect into the centrifugal dryer 1.

The pellet/fluid mixture guided through the inlet shaft 8 is conveyed upwardly by the rotor 4 within the screen 6, with the fluid being separated radially. The outlet 9 which is shown in FIG. 1 and through which the pellets separated from the fluid can be discharged from the centrifugal dryer 1 is provided at an upper end section of the rotor 4.

Figure 3:
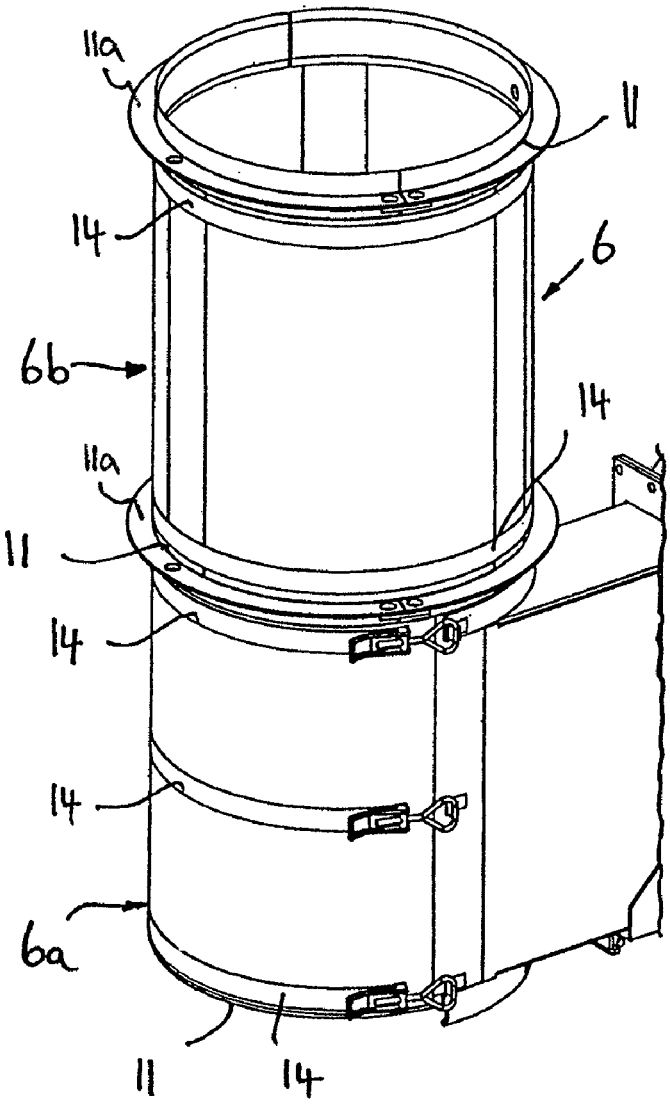
FIG. 3: a schematic rear view of the screen of FIG. 2 which shows the connection of the inlet shaft to the lower screen member.

As FIGS. 2 and 3 show, the screen 6 is composed of a plurality of screen members 10 which are each made up of elastic, porous screen boards or plates which are planar or slightly pre-arched, in particular pre-rolled or suitably curved in a different manner in the starting state and which have been brought into the arcuate or cylindrical shape shown in the Figures. More precisely, the screen members 10 in this respect each form cylinder jacket surface sections since the screen 6 is composed, viewed in the peripheral direction, of a plurality of screen members 10*a*, 10*b*, 10*c* . . . which mutually overlap and together form a screen ring. In this respect, the screen 6 is not only composed of a plurality of screen members 10 when viewed in the peripheral direction, but also when viewed in the axial direction. In this respect, FIGS. 2 and 3 show two screen sections 6*a* and 6*b* which are separate in the axial direction and which are each formed from a plurality of screen members 10, with the lower screen section 6*a* comprising two screen members 10 in the drawn embodiment, whereas the upper screen section 6*b* is composed of three screen members 10.

Figure 4:
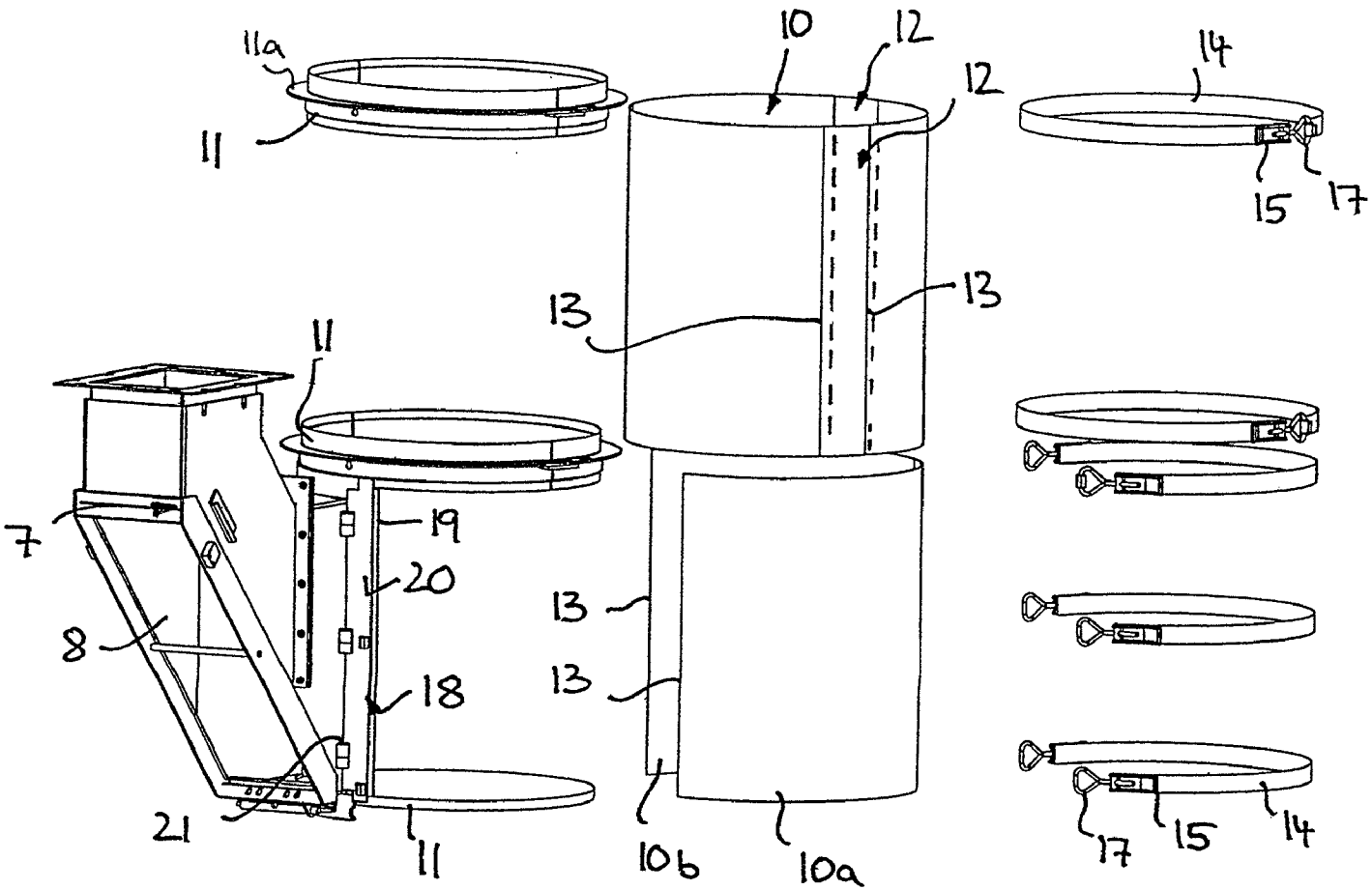
FIG. 4: an exploded representation of the screen and of the inlet shaft which can be connected to it from the preceding Figures which shows the plurality of screen members, the screen carrier hoops and the tension belts for the fastening of the screen members to the screen carrier hoops.

The screen members are in this respect each wound around screen carrier hoops 11, which carrier hoops 11 have radial separation webs 11*a*, at their end-face end sections, with a common screen carrier hoop 11 being provided for both screen sections 6a and 6*b* between the two screen sections 6*a* and 6*b*, cf. also FIG. 4. The lower screen carrier hoop 11 of the lower screen section 6a is in this respect simultaneously made as the screen base, cf. FIG. 4.

The upper screen section 6*b* is in this respect made completely cylindrical, i.e. the screen members 10 surround the total jacket surface of the screen section 6*b*, with the plurality of screen members 10 mutually overlapping at their axial rims. The screen members 10 are in this respect formed free of holding pieces or connection members at their mutually adjacent axial edges or rims 13 which form the respective overlap regions 12. They only lie over one another due to the overlap region 12, with a sealing member, for example in the form of a band, optionally being able to be placed therebetween.

The screen members 10 are held together and fastened by tension belts or tension bands 14 which can be formed by differently made tension members, for example in the form of ropes, belts or hoops. In accordance with a preferred embodiment of the invention, the tension belts 14 could preferably be made of resiliently flexible, tension-resistant, flat bands, preferably made of metal. The tension belts 14 can in this respect be laid around the screen members 10 so that they wrap around the latter, with the tension belts 14 preferably being laid around the screen members 10 in the region of the screen carrier hoops 11 so that the screen members 10 can be clamped onto the screen carrier hoops 11 by clamping the tension belts 14. For this purpose, fast clamping elements in the form of clamping levers 15 are provided at the tension belts 14 which can be actuated without tools and which are fastened to an end of the tension belts 14. In the tension belts 14 of the upper screen section 6b, the clamping levers 15 can in this respect be hung at the oppositely disposed ends of the tension belts 14 on hangers 16 provided there so that only the clamping levers 15 have to be switched to clamp the tension belts 14. Advantageously, in this respect, the effective length of hanging elements 17 which are fastened to the clamping levers 15 and which can be hung at the hanger 16 can be adjusted, for example in that they can be screwed into the clamping levers 15 so that the length of the clamping levers 15, and thus the tension for the tension belts 14, can be adjusted by rotating the hanging elements 17. As can be seen, the hangers 16 act as pivot connection points for the hanging elements 17.

The screen members 10 are not arranged over the full periphery in the region of the lower screen section 6*a*. They rather only include a cylinder sector of less than 360°. A cut-out of the screen members 10 is in particular provided in the region of the inlet shaft 8 to be connected to the jacket-surface side in order to be able to introduce the pellet/process water mixture.

However, the screen members 10 of the screen section 6*b* are also advantageously held together and fastened to the connection body 7 on the jacket surface side in the form of the inlet shaft 8 by tension belts 14, with the tension belts 14 advantageously satisfying the function of fastening the connection body 7 to the screen 6.

As FIG. 4 shows, two screen carrier hoops 11 can be attached and/or fastened to the connection body 7 in the form of the inlet shaft 8 and the screen members 10 of said screen section 6*b* can be laid around them. Advantageously, in this respect, the screen members 10 can be aligned in a simple manner with an exact fit to the contour of the connection body 7 by the tension belt fastening and in that a plurality of screen members 10 are provided which mutually overlap at the peripheral side. The screen members 10 for this purpose only have to be moved slightly to and fro in the peripheral direction, with this being made possible by the loose overlap of the screen members 10.

Figure 5:
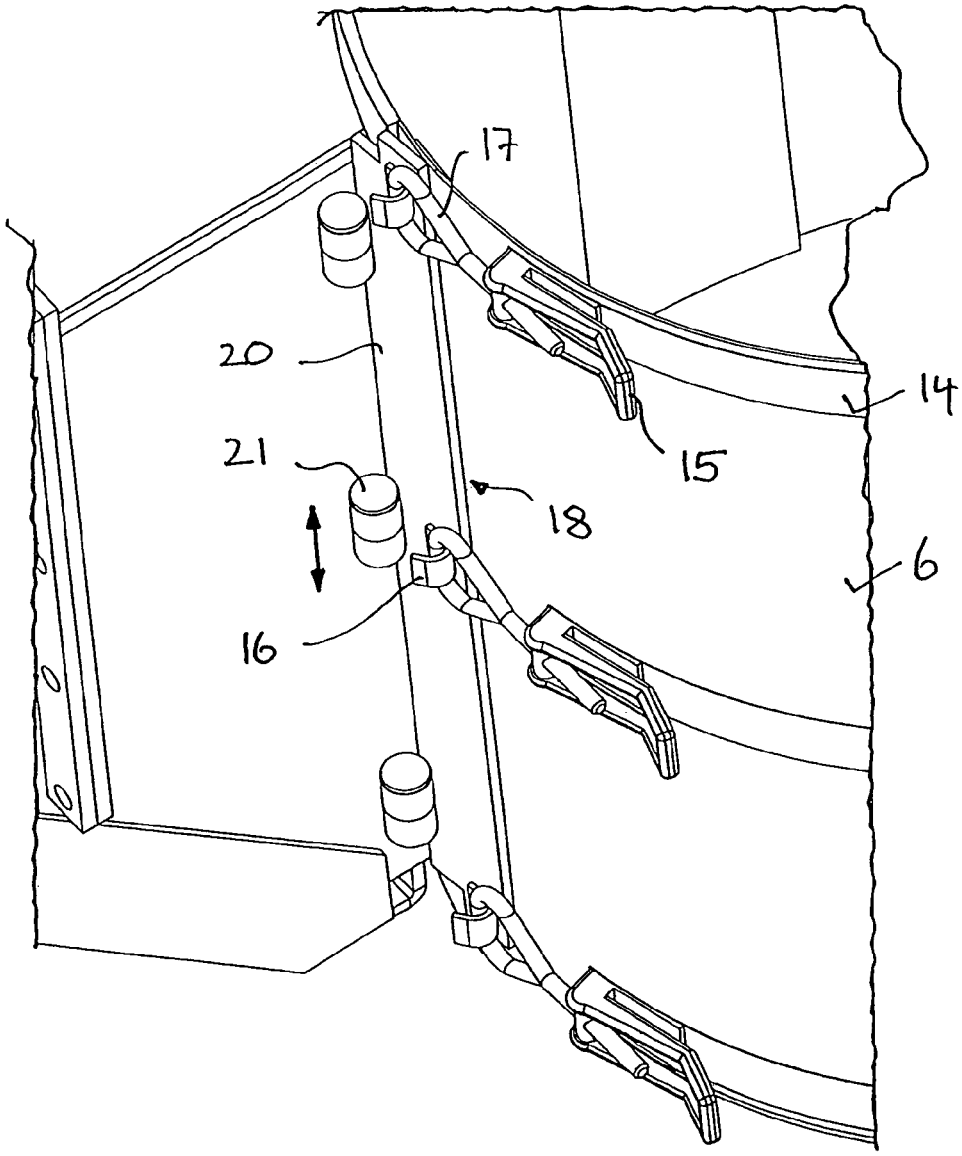
FIG. 5: a section-wise, enlarged representation of the interface between the inlet shaft and the screen which shows a pivotable clamping rail which is releasable from the inlet shaft and the tension belts hinged thereto.

For the connection of the connection body 7 to the screen members 10, a respective slit-shaped clamping mouth 18 into which the screen members 10 can be respectively pushed is provided at the axial connection sides of the connection body 7. As FIGS. 4 and 5 show, these clamping mouths 18 are in each case formed to the right and to the left at the inlet shaft 8 by a—roughly speaking—tangentially extending marginal web 19 as well as by a clamping rail 20 which is disposed above this marginal web 19 and can be fastened to the connection body 7 pivotably around a hinge axis 21 parallel to the longitudinal axis of the screen 6. The clamping rail 20 can advantageously be separated from the connection body 7 by axial pulling, with the hinge bolts releasing 21 in this respect which form the pivotal connection of the clamping rail 20 to the connection body 7.

As FIGS. 4 and 5 show, the tension belts 14 can be pivotally connected to the clamping rail 20 which for this purpose has corresponding hangers 16 at which the hanging element 17 of the clamping levers 15 can be hung. If the clamping levers 15, and hereby the tension belts 14, are tensioned, the rims of the screen members 10 disposed beneath the clamping rail 20 are clamped since the clamping rail 20 rotates about the hinge bolts 21 and carries out a corresponding clamping movement.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A centrifugal dryer for separating pelleted substances from a fluid, having a housing, a rotor arranged in the housing as well as a screen surrounding the rotor at a peripheral side thereof, wherein the screen has at least one porous screen member which forms at least one sector of a peripheral surface of the screen and is placed in arcuate form around at least one screen carrier hoop and is releasably fastened thereto, and wherein the screen is connectable to a connection body arranged at the peripheral side, wherein the screen has mutually overlapping screen member ends, viewed in a peripheral direction, which are each clamped tight on the screen carrier hoop by at least one tension belt which wraps around the mutually overlapping screen members at the peripheral side, wherein the connection body has a clamping device adjacent to the screen, with a respective screen member adjacent to the connection body being clampable by said clamping device to a screen member end overlapping the connection body in the peripheral direction wherein at least one screen carrier hoop can be set and/or fastened to the connection body.

2. The centrifugal dryer in accordance with claim 1, wherein the screen members are themselves made free of fastening and holding members, lie loosely on one another in their mutually overlapping sections, and are only held together by the at least one tension belt.

3. The centrifugal dryer in accordance with claim 1, wherein the screen members are made free of weld spots and weld seams.

4. The centrifugal dryer in accordance with claim 1, wherein the screen arranged in a rotationally standing manner and the rotor is supported rotatably relative to the screen.

5. The centrifugal dryer in accordance with claim 1, wherein the screen has at least two screen carrier hoops which are arranged at end sections of the screen members at both sides, with the screen members being clamped to each of the screen carrier hoops by means of corresponding tension belts.

6. The centrifugal dryer in accordance with claim 1, wherein the screen composed, viewed in an axial direction of the screen, of a plurality of screen members which are fastened alone in each case on screen carrier hoops by tension belts, with a common screen carrier hoop being provided between two screen sections adjacent in the axial direction, with the plurality of screen members, viewed in the axial direction, of the two screen sections being clamped onto said common screen carrier hoop.

7. The centrifugal dryer in accordance with claim 1, wherein the common screen carrier hoop has a radial separation web in a central section which separates two axially separate clamping sections at the peripheral side and toward which the screen sections can be aligned from oppositely disposed sides, with the two screen sections being clamped tight by means of a respective tension belt on one of the clamping sections of the common screen carrier hoop at the peripheral side.

8. The centrifugal dryer in accordance with claim 1, wherein the screen has a cut-out at the peripheral side in the region of the connection body in which no screen member is arranged and a screen member adjacent to the connection body at the peripheral side can be connected to a rim of the connection body free of leaks.

9. The centrifugal dryer in accordance with claim 1, wherein the screen in its screen section, to which the connection body can be connected, is composed, viewed in the peripheral direction, of a plurality of screen members which can be displaced relative to one another in the peripheral direction in their overlap region.

10. The centrifugal dryer in accordance with claim 1, wherein pivot connection points formed by hangers for the at least one tension belt are provided at the connection body.

11. The centrifugal dryer in accordance with claim 1, wherein the tension belt has a clamping element actuable without tools, said clamping element including a clamping lever at one end of the tension belt and a hanger element for the clamping lever and/or with a further clamping lever at an other end of the tension belt.

12. The centrifugal dryer in accordance with claim 1, wherein the at least one tension belt is secured against slipping at least one of the screen members, by at least one securing element selected from the group consisting of a weld spot and an adhesive bond.

13. The centrifugal dryer in accordance with claim 1, wherein the screen members are displaceable with respect to one another in the peripheral direction with a released tension belt.

14. A centrifugal dryer for separating pelleted substances from a fluid, having a housing, a rotor arranged in the housing as well as a screen surrounding the rotor at a peripheral side thereof, wherein the screen has at least one porous screen member which forms at least one sector of a peripheral surface of the screen and is placed in arcuate form around at least one screen carrier hoop and is releasably fastened thereto, and wherein the screen is connectable to a connection body arranged at the peripheral side, wherein the screen has mutually overlapping screen member ends, viewed in a peripheral direction, which are each clamped tight on the screen carrier hoop by at least one tension belt which wraps around the mutually overlapping screen members at the peripheral side, wherein the connection body has a clamping device adjacent to the screen, with a respective screen member adjacent to the connection body being clampable by said clamping device to a screen member end overlapping the connection body in the peripheral direction and wherein the connection body can be fastened to the screen by at least one tension belt which simultaneously wraps around and fixes a screen member provided in a region of the connection body.

15. The centrifugal dryer in accordance with claim 14, wherein the screen members are themselves made free of fastening and holding members, lie loosely on one another in their mutually overlapping sections, and are only held together by the at least one tension belt.

16. The centrifugal dryer in accordance with claim 14, wherein the screen members are made free of weld spots and weld seams.

17. The centrifugal dryer in accordance with claim 14, wherein the screen is arranged in a rotationally standing manner and the rotor is supported rotatably relative to the screen.

18. The centrifugal dryer in accordance with claim 14, wherein the screen has at least two screen carrier hoops with are arranged at end sections of the screen members at both sides, with the screen members being clamped to each of the screen carrier hoops by means of corresponding tension belts.

19. The centrifugal dryer in accordance with claim 14, wherein the screen is composed, viewed in an axial direction of the screen, of a plurality of screen members which are fastened alone in each case on screen carrier hoops by tension belts, with a common screen carrier hoop being provided between two screen sections adjacent in the axial direction, with the plurality of screen members, viewed in the axial direction, of the two screen sections being clamped onto said common screen carrier hoop.

20. The centrifugal dryer in accordance with claim 19, wherein the common screen carrier hoop has a radial separation web in a central section which separates two axially separate clamping sections at the peripheral side and toward which the screen sections can be aligned from oppositely disposed sides, with the two screen sections being clamped tight by means of a respective tension belt on one of the clamping sections of the common screen carrier hoop at the peripheral side.

21. The centrifugal dryer in accordance with claim 14, wherein the screen has a cut-out at the peripheral side in the region of the connection body in which no screen member is arranged and a screen member adjacent to the connection body at the peripheral side can be connected to a rim of the connection body free of leaks.

22. The centrifugal dryer in accordance with claim 14, wherein the screen in its screen section, to which the connection body can be connected, is composed, viewed in the peripheral direction, of a plurality of screen members which can be displaced relative to one another in the peripheral direction in their overlap region.

23. The centrifugal dryer in accordance with claim 14, wherein pivot connection points formed by hangers for the at least one tension belt are provided at the connection body.

24. The centrifugal dryer in accordance with claim 14, wherein the tension belt has a clamping element actuable without tools, said clamping element including a clamping lever at one end of the tension belt and a hanger element for the clamping lever and/or with a further clamping lever at an other end of the tension belt.

25. The centrifugal dryer in accordance with claim 14, wherein the at least one tension belt is secured against slipping at least one of the screen members, by at least one securing element selected from the group consisting of a weld spot and an adhesive bond.

26. The centrifugal dryer in accordance with claim 14, wherein the screen members are displaceable with respect to one another in the peripheral direction with a released tension belt.

27. A centrifugal dryer for separating pelleted substances from a fluid, having a housing, a rotor arranged in the housing as well as a screen surrounding the rotor at a peripheral side thereof, wherein the screen has at least one porous screen member which forms at least one sector of a peripheral surface of the screen and is placed in arcuate form around at least one screen carrier hoop and is releasably fastened thereto, and wherein the screen is connectable to a connection body arranged at the peripheral side, wherein the screen has mutually overlapping screen member ends, viewed in a peripheral direction, which are each clamped tight on the screen carrier hoop by at least one tension belt which wraps around the mutually overlapping screen members at the peripheral side, wherein the connection body has a clamping device adjacent to the screen, with a respective screen member adjacent to the connection body being clampable by said clamping device to a screen member end overlapping the connection body in the peripheral direction, wherein the connection body has clamping mouths which can be clamped together by at least one tension belt.

28. The centrifugal dryer in accordance with claim 27, wherein the screen members are themselves made free of fastening and holding members, lie loosely on one another in their mutually overlapping sections, and are only held together by the at least one tension belt.

29. The centrifugal dryer in accordance with claim 27, wherein the screen members are made free of weld spots and weld seams.

30. The centrifugal dryer in accordance with claim 27, wherein the screen is arranged in a rotationally standing manner and the rotor is supported rotatably relative to the screen.

31. The centrifugal dryer in accordance with claim 27, wherein the screen has at least two screen carrier hoops which are arranged at end sections of the screen members at both sides, with the screen members being clamped to each of the screen carrier hoops by means of corresponding tension belts.

32. The centrifugal dryer in accordance with claim 27, wherein the screen is composed, viewed in an axial direction of the screen, of a plurality of screen members which are fastened alone in each case on screen carrier hoops by tension belts, with a common screen carrier hoop being provided between two screen sections adjacent in the axial direction, with the plurality of screen members, viewed in the axial direction, of the two screen sections being clamped onto said common screen carrier hoop.

33. The centrifugal dryer in accordance with claim 32, wherein the common screen carrier hoop has a radial separation web in a central section which separates two axially separate clamping sections at the peripheral side and toward which the screen sections can be aligned from oppositely disposed sides, with the two screen sections being clamped tight by means of a respective tension belt on one of the clamping sections of the common screen carrier hoop at the peripheral side.

34. The centrifugal dryer in accordance with claim 27, wherein the screen has a cut-out at the peripheral side in the region of the connection body in which no screen member is arranged and a screen member adjacent to the connection body at the peripheral side can be connected to a rim of the connection body free of leaks.

35. The centrifugal dryer in accordance with claim 27, wherein the screen in its screen section, to which the connection body can be connected, is composed, viewed in the peripheral direction, of a plurality of screen members which can be displaced relative to one another in the peripheral direction in their overlap region.

36. The centrifugal dryer in accordance with claim 27, wherein pivot connection points formed by hangers for the at least one tension belt are provided at the connection body.

37. The centrifugal dryer in accordance with claim 27, wherein the tension belt has a clamping element actuable without tools, said clamping element including a clamping lever at one end of the tension belt and a hanger element for the clamping lever and/or with a further clamping lever at an other end of the tension belt.

38. The centrifugal dryer in accordance with claim 27, wherein the at least one tension belt is secured against slipping at least one of the screen members, by at least one securing element selected from the group consisting of a weld spot and an adhesive bond.

39. The centrifugal dryer in accordance with claim 27, wherein the screen members are displaceable with respect to one another in the peripheral direction with a released tension belt.

40. A centrifugal dryer for separating pelleted substances from a fluid, having a housing, a rotor arranged in the housing as well as a screen surrounding the rotor at a peripheral side thereof, wherein the screen has at least one porous screen member which forms at least one sector of a peripheral surface of the screen and is placed in arcuate form around at least one screen carrier hoop and is releasably fastened thereto, and wherein the screen is connectable to a connection body arranged at the peripheral side, wherein the screen has mutually overlapping screen member ends, viewed in a peripheral direction, which are each clamped tight on the screen carrier hoop by at least one tension belt which wraps around the mutually overlapping screen members at the peripheral side, wherein the connection body has a clamping device adjacent to the screen, with a respective screen member adjacent to the connection body being clampable by said clamping device to a screen member end overlapping the connection body in the peripheral direction, wherein at least one clamping rail at which the at least one tension belt can be hinged can be fastened releasably and/or pivotally to the connection body.

41. The centrifugal dryer in accordance with claim 40, wherein the screen members are themselves made free of fastening and holding members, lie loosely on one another in their mutually overlapping sections, and are only held together by the at least one tension belt.

42. The centrifugal dryer in accordance with claim 40, wherein the screen members are made free of weld spots and weld seams.

43. The centrifugal dryer in accordance with claim 40, wherein the screen is arranged in a rotationally standing manner and the rotor is supported rotatably relative to the screen.

44. The centrifugal dryer in accordance with claim 40, wherein the screen has at least two screen carrier hoops which are arranged at end sections of the screen members at both sides, with the screen members being clamped to each of the screen carrier hoops by means of corresponding tension belts.

45. The centrifugal dryer in accordance with claim 40, wherein the screen is composed, viewed in an axial direction of the screen, of a plurality of screen members which are fastened alone in each case on screen carrier hoops by tension belts, with a common screen carrier hoop being provided between two screen sections adjacent in the axial direction, with the plurality of screen members, viewed in the axial direction, of the two screen sections being clamped onto said common screen carrier hoop.

46. The centrifugal dryer in accordance with claim 45, wherein the common screen carrier hoop has a radial separation web in a central section which separates two axially separate clamping sections at the peripheral side and toward which the screen sections can be aligned from oppositely disposed sides, with the two screen sections being clamped tight by means of a respective tension belt on one of the clamping sections of the common screen carrier hoop at the peripheral side.

47. The centrifugal dryer in accordance with claim 40, wherein the screen has a cut-out at the peripheral side in the region of the connection body in which no screen member is arranged and a screen member adjacent to the connection body at the peripheral side can be connected to a rim of the connection body free of leaks.

48. The centrifugal dryer in accordance with claim 40, wherein the screen in its screen section, to which the connection body can be connected, is composed, viewed in the peripheral direction, of a plurality of screen members which can be displaced relative to one another in the peripheral direction in their overlap region.

49. The centrifugal dryer in accordance with claim 40, wherein pivot connection points formed by hangers for the at least one tension belt are provided at the connection body.

50. The centrifugal dryer in accordance with claim 40, wherein the tension belt has a clamping element actuable without tools, said clamping element including a clamping lever at one end of the tension belt and a hanger element for the clamping lever and/or with a further clamping lever at an other end of the tension belt.

51. The centrifugal dryer in accordance with claim 40, wherein the at least one tension belt is secured against slipping at least one of the screen members, by at least one securing element selected from the group consisting of a weld spot and an adhesive bond.

52. The centrifugal dryer in accordance with claim 40, wherein the screen members are displaceable with respect to one another in the peripheral direction with a released tension belt.

53. The centrifugal dryer in accordance with claim 40, wherein the clamping rail is releasably hangable at the connection body, is in particular insertable in the axial direction, by means of hinge joint bolts.

* * * * *